US010236629B2

(12) United States Patent
Narro et al.

(10) Patent No.: US 10,236,629 B2
(45) Date of Patent: Mar. 19, 2019

(54) ELECTRICAL CONNECTOR WITH RETRACTABLE TERMINAL-STABILIZER

(71) Applicant: Aptiv Technologies Limited, St. Michael (BB)

(72) Inventors: Roberto C. Narro, Coahuila (MX); Marcelino Hernandez, Coahuila (MX)

(73) Assignee: APTIV TECHNOLOGIES LIMITED (BB)

( * ) Notice: Subject to any disclaimer, the term of this patent is extended or adjusted under 35 U.S.C. 154(b) by 0 days.

(21) Appl. No.: 15/588,777

(22) Filed: May 8, 2017

(65) Prior Publication Data

US 2018/0323538 A1 Nov. 8, 2018

(51) Int. Cl.

| | |
|---|---|
| ***H01R 13/44*** | (2006.01) |
| ***H01R 13/629*** | (2006.01) |
| ***H01R 13/518*** | (2006.01) |
| ***H01R 13/639*** | (2006.01) |

(52) U.S. Cl.

CPC ..... *H01R 13/629* (2013.01); *H01R 13/518* (2013.01); *H01R 13/639* (2013.01)

(58) Field of Classification Search

CPC ..... H01R 13/4538; H01R 13/447; H01R 13/62938; H01R 13/6272; H01R 13/62933; H01R 13/631

USPC ..... 439/140, 141, 144, 157, 352, 372, 374

See application file for complete search history.

(56) References Cited

U.S. PATENT DOCUMENTS

| | | | | |
|---|---|---|---|---|
| 5,437,558 A * | 8/1995 | Sakuraoka | H01R 13/631 439/140 |
| 5,715,135 A | 2/1998 | Brussalis et al. | |
| 5,788,529 A | 8/1998 | Borzi et al. | |
| 5,961,337 A * | 10/1999 | Kordes | H01R 13/4538 439/141 |
| 6,220,876 B1 | 4/2001 | Avila et al. | |
| 6,422,881 B1 | 7/2002 | Puhl et al. | |

(Continued)

FOREIGN PATENT DOCUMENTS

JP 2016-042455 A 3/2016

*Primary Examiner* — Thanh Tam T Le

(74) *Attorney, Agent, or Firm* — Joseph Victor Bonadies

(57) ABSTRACT

An electrical connector assembly includes a connector, a corresponding mating-connector, and a terminal-stabilizer. The a connector has a plurality of electrical-terminals. The connector also has an outer-surface that includes a plurality of retraction-fins. The mating-connector has a plurality of mating-electrical-terminals. The mating-connector is releasably connected to the connector along a mating-axis. The mating-connector includes a connector-shroud having side walls defining a shroud-cavity. The terminal-stabilizer is slideably disposed within the shroud-cavity and includes a plurality of retraction-locks that engage the plurality of retraction-fins on the connector. The terminal-stabilizer defines a plurality of terminal-apertures that slideably engage the plurality of mating-electrical-terminals. The terminal-stabilizer is moveable from a prestaged-position, when the connector and the mating-connector are in the unmated-position, to a seated-position, when the connector is moved to the mated-position. The connector retracts the terminal-stabilizer from the seated-position to the prestaged-position when the connector is moved from the mated-position to the unmated-position.

7 Claims, 6 Drawing Sheets

(56) References Cited

U.S. PATENT DOCUMENTS

| | | | | |
|---|---|---|---|---|
| 6,692,274 | B2 * | 2/2004 | Maegawa | H01R 13/62933 439/157 |
| 6,739,889 | B1 | 5/2004 | Daggett et al. | |
| 6,761,568 | B2 | 7/2004 | Bakker et al. | |
| 6,821,135 | B1 * | 11/2004 | Martin | H01R 13/629 439/141 |
| 6,976,858 | B1 * | 12/2005 | Kikuchi | H01R 13/4538 439/140 |
| 7,179,136 | B1 | 2/2007 | Morello | |
| 7,578,709 | B2 | 8/2009 | Daudin et al. | |
| 7,635,212 | B2 | 12/2009 | Seidler | |
| 7,670,177 | B2 * | 3/2010 | Myer | H01R 13/4223 439/595 |
| 8,038,455 | B1 | 10/2011 | Moraes et al. | |
| 8,267,702 | B2 | 9/2012 | De La Reza et al. | |
| 8,267,704 | B2 | 9/2012 | Cheng et al. | |
| 8,926,344 | B2 * | 1/2015 | Jozwiak | B60R 16/0238 439/140 |
| 9,054,454 | B2 | 6/2015 | Gomez et al. | |
| 9,509,081 | B2 * | 11/2016 | Kobayashi | H01R 13/506 |
| 9,520,669 | B2 | 12/2016 | Gerwatowski et al. | |
| 9,748,692 | B1 * | 8/2017 | Pardo | H01R 13/62933 |
| 2002/0168895 | A1 | 11/2002 | Suzuki | |
| 2003/0068910 | A1 | 4/2003 | Casses | |
| 2010/0105254 | A1 | 4/2010 | Park et al. | |

* cited by examiner

ELECTRICAL CONNECTOR WITH RETRACTABLE TERMINAL-STABILIZER

TECHNICAL FIELD OF INVENTION

This disclosure generally relates to an electrical connector assembly, and more particularly relates to an electrical connector assembly having a retractable terminal-stabilizer device.

BACKGROUND OF INVENTION

An electrical distribution center is typically used in automotive vehicles to interconnect various electrical wiring assemblies. The electrical distribution center assembly may also be used in other non-vehicular applications. The typical electrical distribution center may package various fuses, relays, and other electrical devices, in a central location and may include provisions for electrically connecting a power source to electrical wiring harnesses that supply power and control signals to various electrical systems of the vehicle. Examples of electrical distribution centers may be found in U.S. Pat. No. 5,715,135 granted to Brussalis et al., U.S. Pat. No. 5,788,529 granted to Borzi et al., U.S. Pat. No. 6,220,876 granted to Avila et al., U.S. Pat. No. 6,739,889 granted to Daggett et al., and U.S. Pat. No. 7,635,212 granted to Seidler.

A known electrical distribution center that incorporates a connector shroud includes a non-movable floor positioned at the base of male blade electrical terminals to provide some level of blade dimensional stabilization prior to mating with a wiring harness connector. For additional blade stabilization and protection from damage prior to connector mating, a separate electrical terminal stabilizer plate is mounted to the shroud to capture the terminals near the terminal tips. Terminal stabilizer plates also function to keep undesired foreign matter, or debris out of the connector system environment to prevent intermittent electrical connections between the mated terminals, and to prevent blockage between the connectors that may impede the mating of the connection system. The terminal stabilizer plate may be attached using tabs that are inserted into slots in the shroud as shown in U.S. Pat. No. 6,422,881 granted to Puhl, et al.

The terminal stabilizer plate may be integrally molded into shroud with breakaway portions, as shown in U.S. Pat. No. 8,267,704 granted to De La Reza et al. In this design, when the connector body is mated to the electrical distribution center, there is a momentary increase in force needed to insert the connector body into the shroud as the tabs are pushed out of the slots or the breakaway portions are broken.

Jozwiak shows, in U.S. Pat. No. 8,926,344, a terminal stabilizer plate held in the shroud at a ready position by a releasable latch means. In this design, when the connector body is mated to the electrical distribution center, the terminal stabilizer plate is pushed out of flexible locks and toward the connector floor to the base of the terminals.

A retractable terminal stabilizer plate typically couples with the mating connector such that the stabilizer plate moves back to the ready position when the mating connectors is removed. Current retractable stabilizer plate connection systems typically require an undesired high coupling force during the process of mating and unmating of connection system. Reducing the coupling force to operate the retractable stabilizer reduces the overall coupling force needed to mate and unmate the connection system. As current connection system configurations age over their useful service life in an application, the elements of the connection system, including the retractable stabilizer, may become fatigued to the point where the retractable stabilizer may not retract back to the ready position when the connection system is unmated. If the retractable stabilizer remains undesirably positioned deep in the mating connector when the connection system is unmated, an increased portion of the male terminals are exposed above the retractable stabilizer which increases the risk for male terminal damage. Damaged male terminals require servicing to the connection system which undesirably increases repair costs of the connection system.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

SUMMARY OF THE INVENTION

In accordance with one embodiment, an electrical connector assembly is provided. The electrical connector assembly includes a connector, a corresponding mating-connector, and a terminal-stabilizer. The connector has a plurality of electrical-terminals. The connector also has an outer-surface that includes a plurality of retraction-fins. The mating-connector has a plurality of mating-electrical-terminals. The mating-connector is releasably connected to the connector along a mating-axis. The electrical-terminals interconnect with the mating-electrical-terminals when the connector is moved from an unmated-position to a mated-position. The mating-connector includes a connector-shroud having side walls defining a shroud-cavity configured to receive the connector therein and a base. The terminal-stabilizer is slideably disposed within the shroud-cavity and includes a plurality of retraction-locks that engage the plurality of retraction-fins on the connector. The terminal-stabilizer defines a plurality of terminal-apertures that slideably engage the plurality of mating-electrical-terminals. The terminal-stabilizer is moveable from a prestaged-position, when the connector and the mating-connector are in the unmated-position, to a seated-position, when the connector is moved to the mated-position. The connector retracts the terminal-stabilizer from the seated-position to the prestaged-position when the connector is moved from the mated-position to the unmated-position.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION

Figure 1:
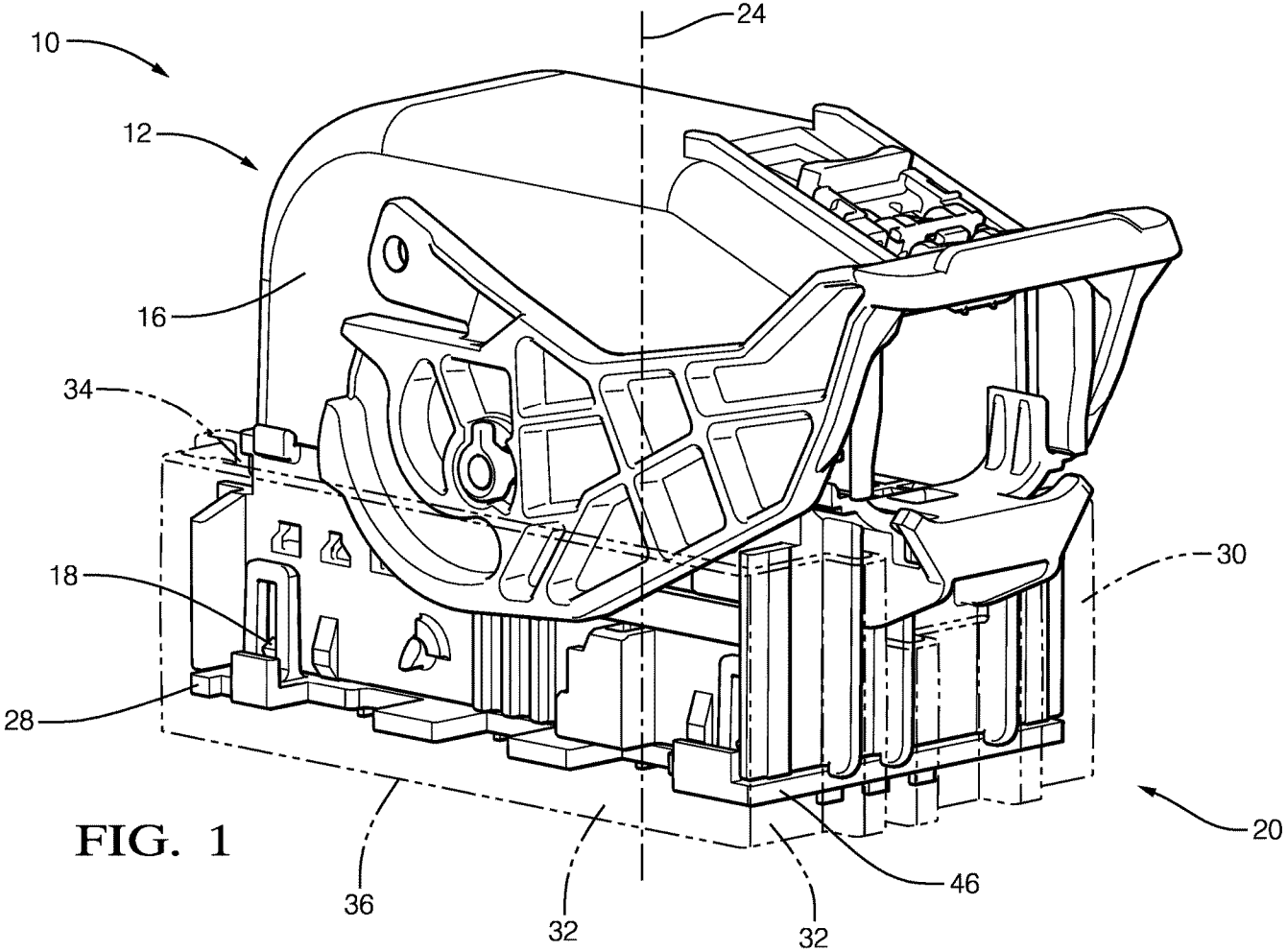
FIG. 1 is an illustration of a cut-away view of an electrical connector assembly in accordance with one embodiment.

FIG. 1 illustrates a non-limiting example of an electrical connector assembly 10, hereafter referred to as the assembly 10. The assembly 10 includes a connector 12 having a plurality of electrical-terminals 14 (see FIG. 5A), and an outer-surface 16 that has a plurality of retraction-fins 18.

Figure 2:
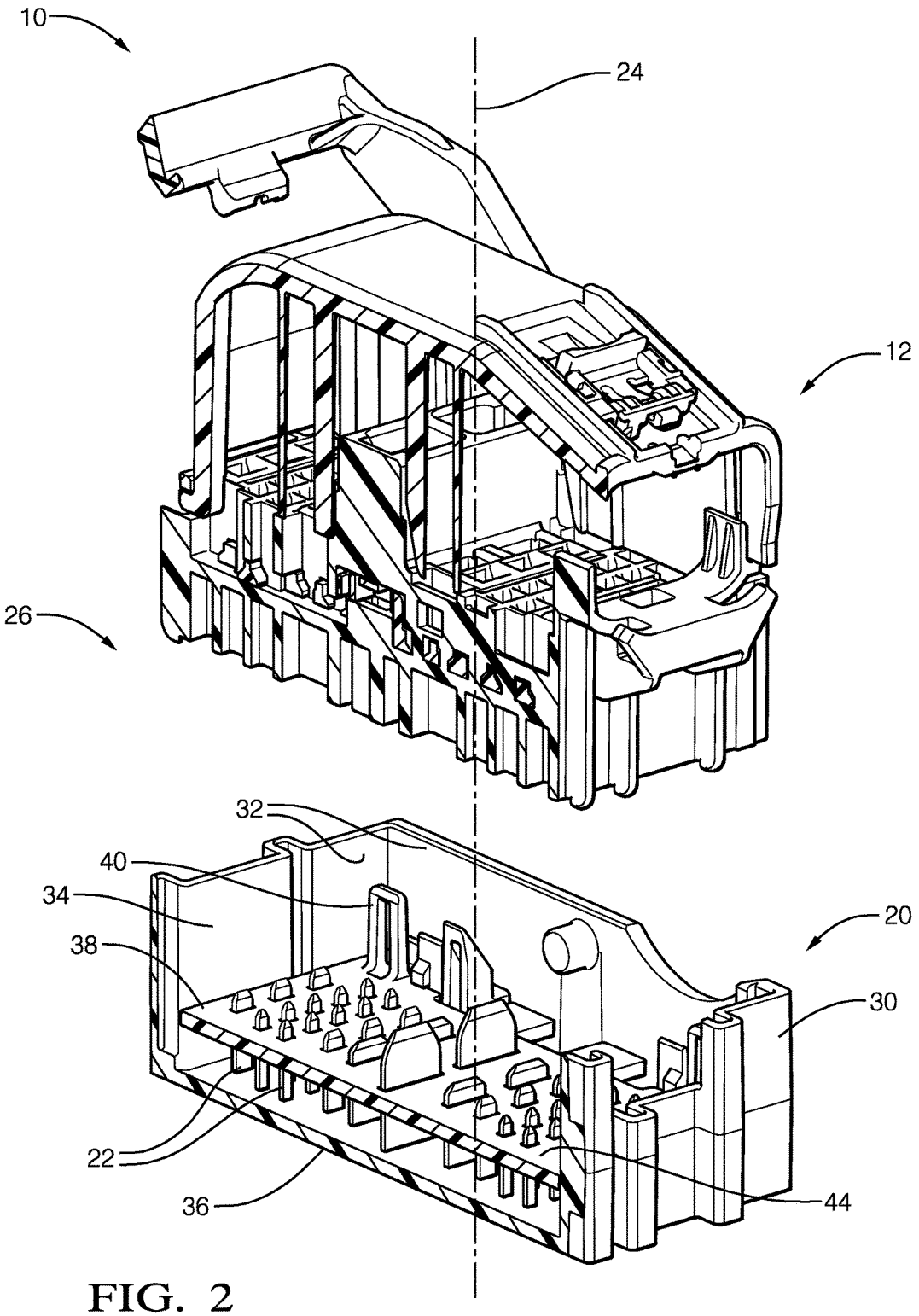
FIG. 2 is an illustration of a cross section view of the connector assembly of FIG. 1 in an unmated position in accordance with one embodiment.
Figure 6:
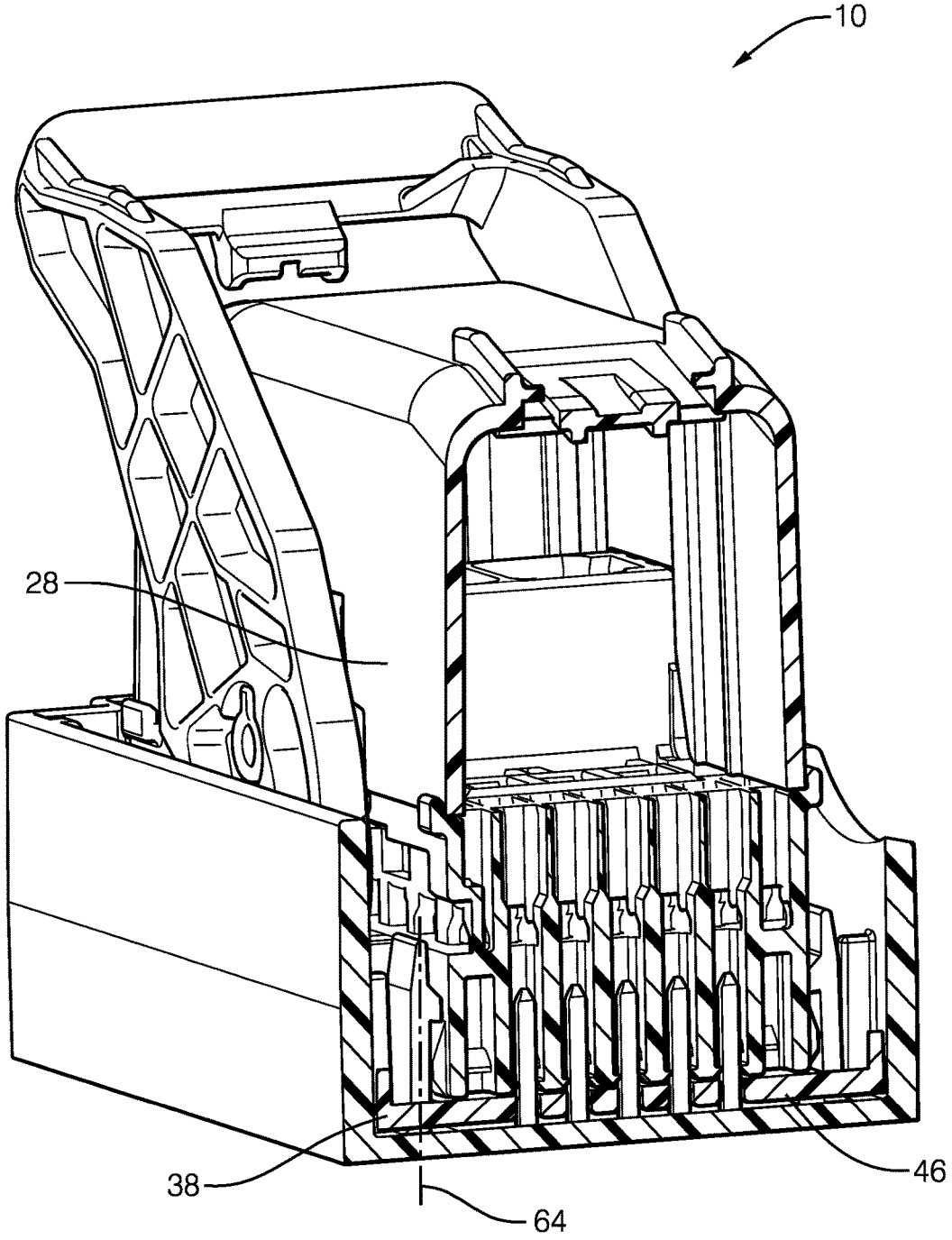
FIG. 6 is a cross section view of an illustration of the connector assembly of FIG. 1 in a mated-position with the terminal-stabilizer in a seated-position in accordance with one embodiment.

The assembly 10 also includes a corresponding mating-connector 20 having a plurality of mating-electrical-terminals 22 (see FIG. 2). The mating-connector 20 is releasably connected to the connector 12 along a mating-axis 24 such that the electrical-terminals 14 mate with the mating-electrical-terminals 22 when the connector 12 is moved from an unmated-position 26 (see FIG. 2) to a mated-position 28 (see FIG. 6). The mating-connector 20 includes a connector-shroud 30 having side walls 32 that define a shroud-cavity 34 configured to receive the connector 12, and a base 36.

Figure 3A:
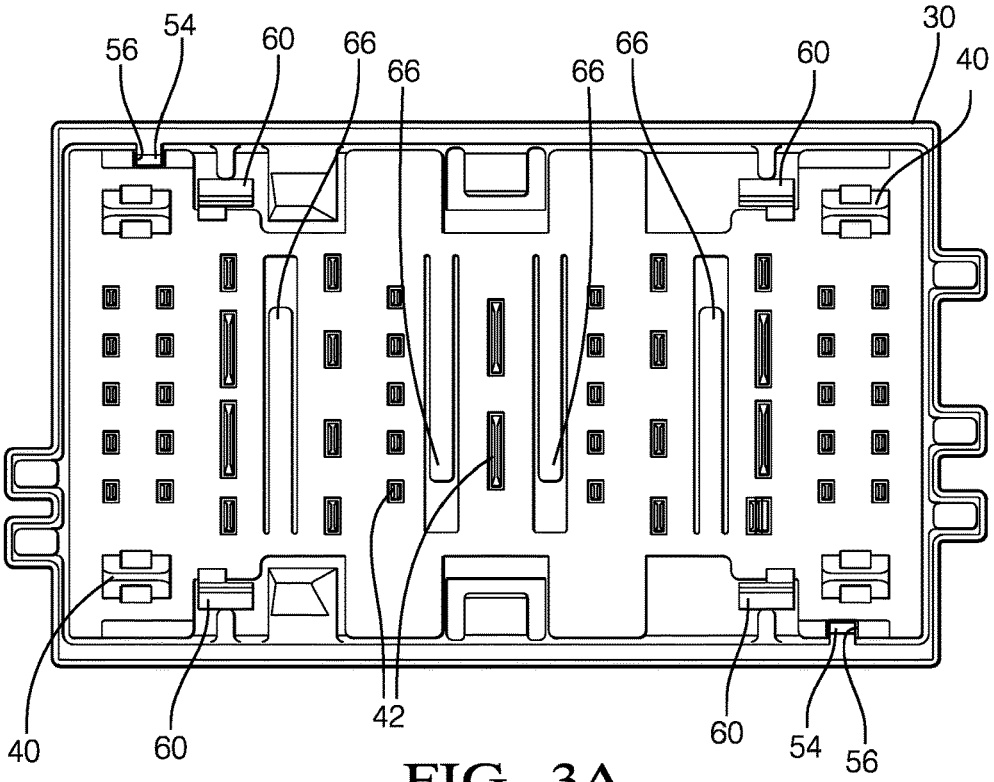
FIG. 3A is an illustration of the terminal-stabilizer disposed of FIG. 2 within the mating-connector of FIG. 2 in accordance with one embodiment.
Figure 3B:
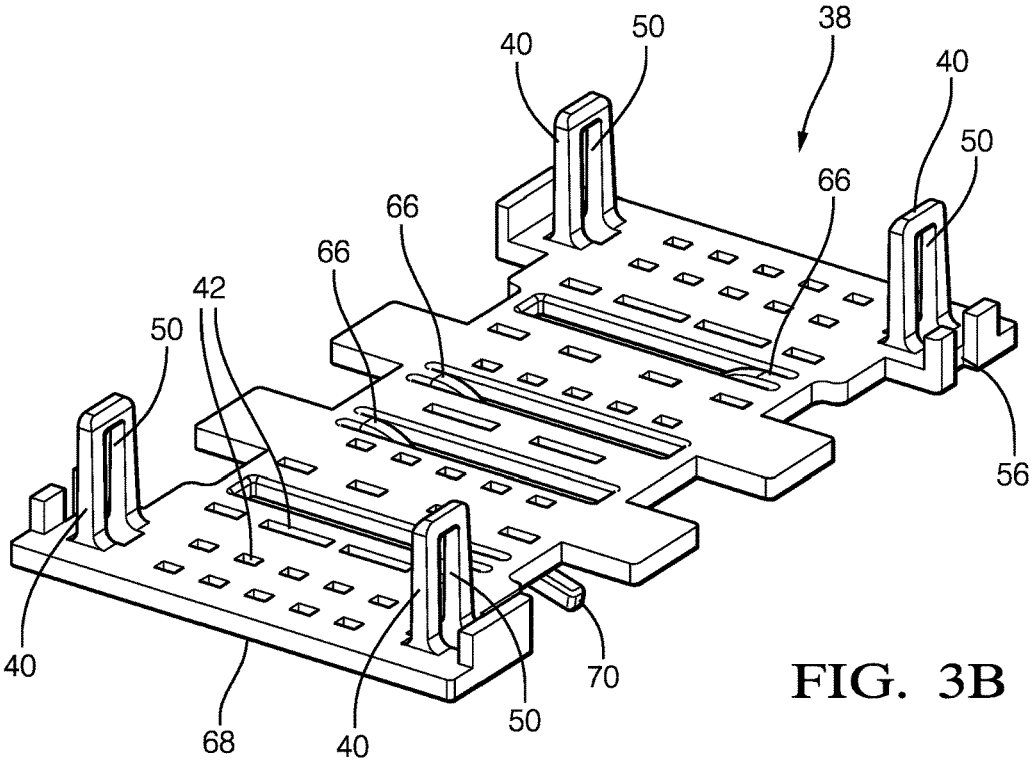
FIG. 3B is an illustration of the terminal-stabilizer of FIG. 2 in accordance with one embodiment.
Figure 4:
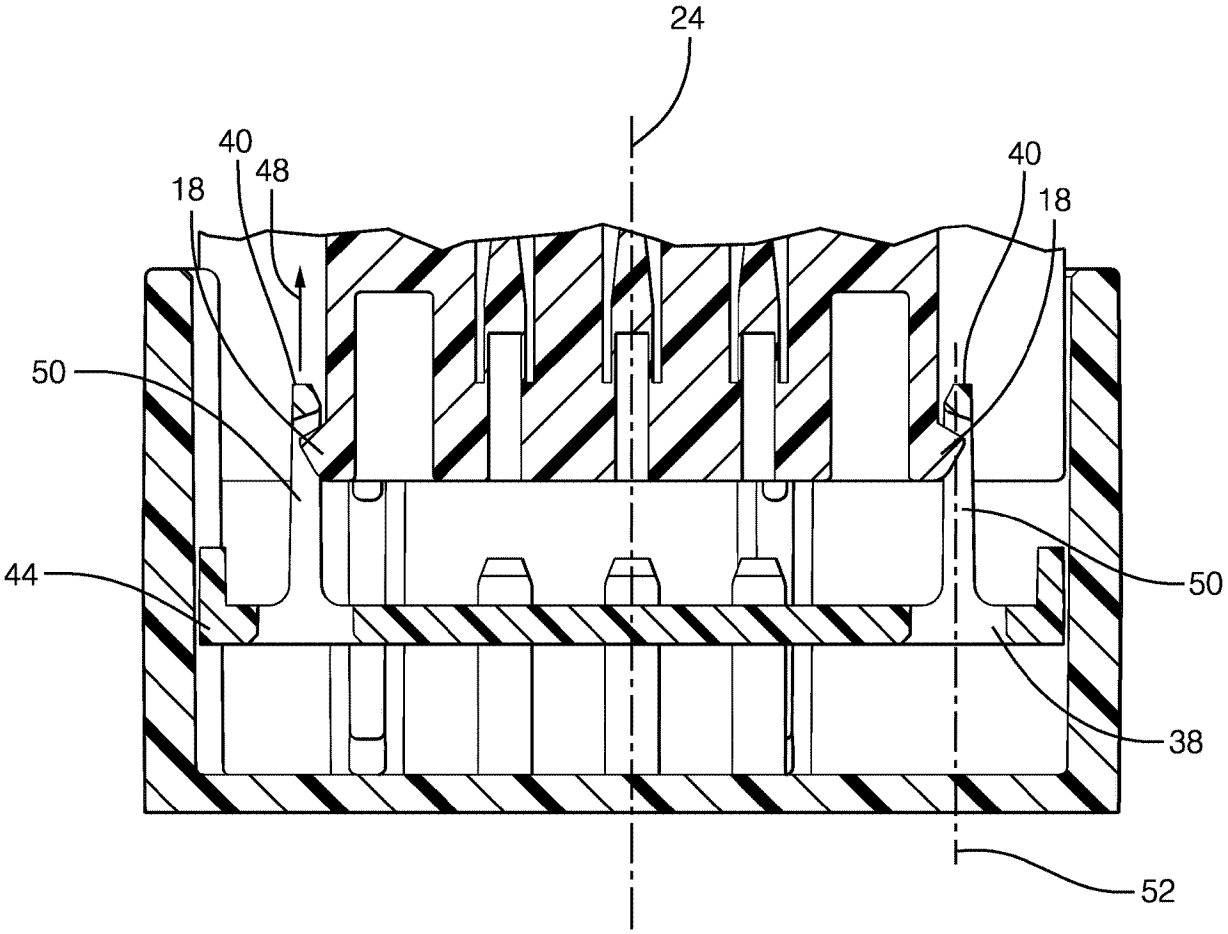
FIG. 4 is an illustration of the connector of FIG. 1 with retraction-fins engaged with retraction-locks of the terminal-stabilizer of FIG. 2 in accordance with one embodiment.

The assembly 10 also includes a terminal-stabilizer 38 (see FIG. 2) slideably disposed within the shroud-cavity 34 that includes a plurality of retraction-locks 40. The terminal-stabilizer 38 defines a plurality of terminal-apertures 42 (see FIGS. 3A and 3B) that slideably engage the plurality of mating-electrical-terminals 22. The retraction-locks 40 may releasably engage the plurality of retraction-fins 18 on the connector 12 when the connector 12 is inserted into the mating-connector 20, as illustrated in FIG. 4. The terminal-stabilizer 38 is moveable from a prestaged-position 44, when the connector 12 and the mating-connector 20 are in the unmated-position 26 (see FIG. 2) to a seated-position 46 when the connector 12 is moved to the mated-position 28 (see FIG. 1).

The connector 12 may retract 48 the terminal-stabilizer 38 from the seated-position 46 to the prestaged-position 44 when the connector 12 is moved from the mated-position 28 to the unmated-position 26 (see FIG. 4). Retracting 48 the terminal-stabilizer 38 to the prestaged-position 44 is advantageous because the terminal-stabilizer 38 may protect the mating-electrical-terminals 22 when the assembly 10 must be disconnected during periods of service. The retraction-fins 18 remain engaged with the retraction-locks 40 until the connector 12 is separated from the mating-connector 20. The retraction-fins 18 are configured with ramps (not specifically shown) on a leading-edge and a trailing-edge that displace the retraction-locks 40 perpendicular to the mating-axis 24 until the retraction-fins 18 are engaged and/or disengaged from the retraction-locks 40. The retraction-locks 40 define a retraction-slot 50 (see FIG. 3B) that slideably retains the retraction-fins 18 and enables the connector 12 to travel to the mated-position 28 with minimal frictional resistance. The retraction-locks 40 may return to a neutral flex-position 52 (see FIG. 4) that does not have a deflection from perpendicular to the mating-axis 24 when the retraction-locks 40 retain the retraction-fins 18.

The connector-shroud 30 may include a plurality of index-beams 54 and the terminal-stabilizer 38 may include a plurality of corresponding index-slots 56 (see FIGS. 3A and 3B) that slideably engage the plurality of index-beams 54. The index-beams 54 ensure a correct installation position of the terminal-stabilizer 38 in the connector-shroud 30 and may prevent any misalignment of the terminal-stabilizer 38 while the connector 12 is moved from the mated-position 28 to the unmated-position 26.

Figure 5B:
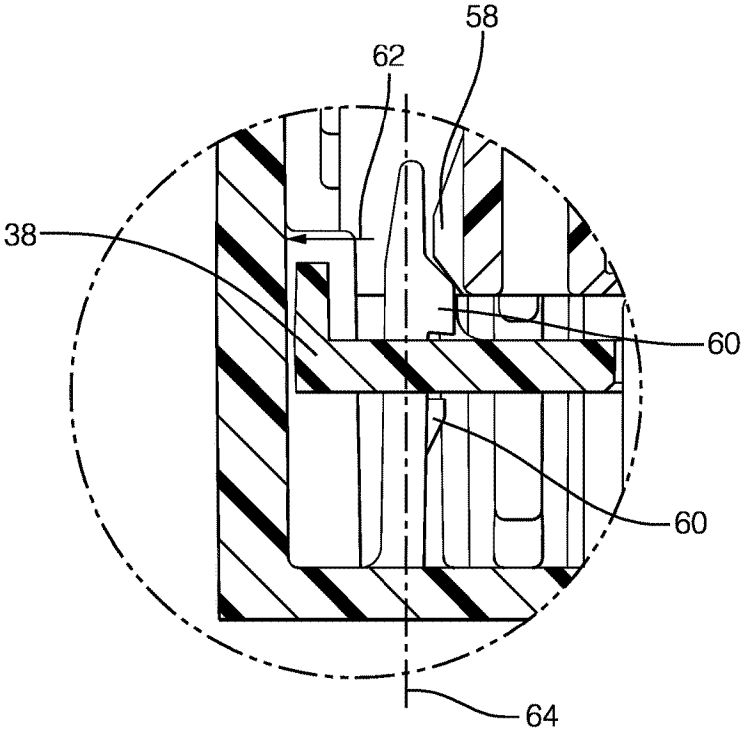
FIG. 5B is a close-up view of the release-ramps and beam-locks of FIG. 5A in accordance with one embodiment.
Figure 5A:
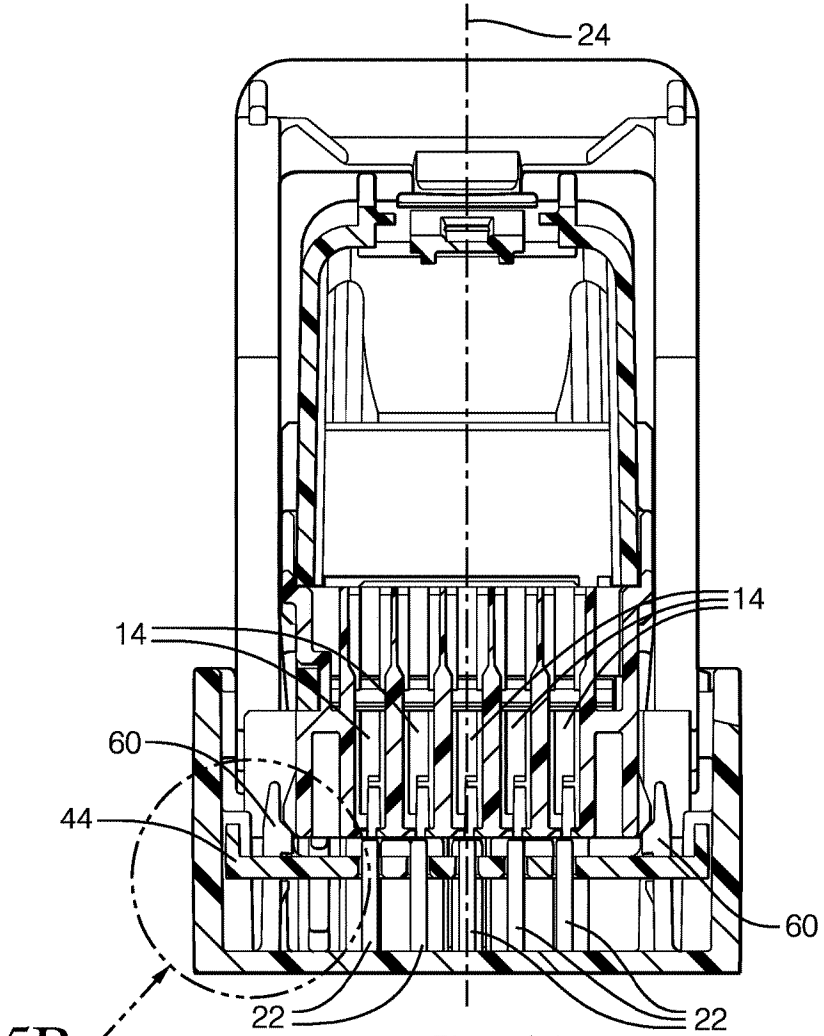
FIG. 5A is an illustration of the electrical connector assembly of FIG. 1 with release-ramps and beam-locks in accordance with one embodiment.

The connector 12 may also include a plurality of release-ramps 58, and the base 36 may also include a plurality of corresponding beam-locks 60 configured to retain the terminal-stabilizer 38 in the prestaged-position 44 (see FIGS. 5A and 5B). The beam-locks 60 prevent movement of the terminal-stabilizer 38 until the retraction-fins 18 engage the retraction-locks 40, and the plurality of release-ramps 58 displace the plurality of beam-locks 60 in a lateral direction 62 perpendicular to the mating-axis 24. The displacement of the beam-locks 60 enables the terminal-stabilizer 38 to move to the seated-position 46 (see FIG. 6) when the connector 12 is moved from the unmated-position 26 to the mated-position 28. The beam-locks 60 may return to a relaxed-position 64 that do not have a deflection from perpendicular to the mating-axis 24 after the terminal-stabilizer 38 is moved to the seated-position 46 (see FIG. 6). When the connector 12 is moved from the mated-position 28 to the unmated-position 26 the retraction-fins 18 retract 48 the terminal-stabilizer 38 until the beam-locks 60 capture edges of the terminal-stabilizer 38 and a pull-out force on the connector 12 exceeds the force required to retain the retraction-fins 18 within the retraction-locks 40, thus disconnecting the assembly 10.

The terminal-stabilizer 38 may further include a resilient member 66 (see FIGS. 3A and 3B) projecting from a bottom-surface 68 of the terminal-stabilizer 38 configured to exert a spring force on the base 36 in order to urge the terminal-stabilizer 38 from the seated-position 46 to the prestaged-position 44. The resilient member 66 may be characterized as having an arcuate shape 70. The terminal-stabilizer 38 may also include a plurality of resilient members 66 projecting from the bottom-surface 68 of the terminal-stabilizer 38 configured to urge the terminal-stabilizer 38 from the seated-position 46 to the prestaged-position 44.

Accordingly, an electrical connector assembly 10 provided. The electrical connector assembly 10 includes the retractable terminal-stabilizer 38 that reduces the overall coupling force needed to mate and unmate the connection system, compared to prior art retractable terminal stabilizers, by eliminating any breakaway features molded into the terminal stabilizer. The release-ramps 58 integrated into the connector 12 further reduce the overall coupling force needed to mate and unmate the connection system by reducing the frictional forces generated through the interaction with the ramp features of the beam-locks 60. The terminal-stabilizer 38 retraction-locks 40 and the mating-connector 20 beam-locks 60 return to the position having no deflection perpendicular to the mating-axis 24 after the terminal-stabilizer 38 is moved to the seated-position 46.

While this invention has been described in terms of the preferred embodiments thereof, it is not intended to be so limited, but rather only to the extent set forth in the claims that follow. Moreover, the use of the terms first, second, etc.

does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

We claim:

1. An electrical connector assembly comprising:

a connector having a plurality of electrical-terminals, said connector having an outer-surface that includes a plurality of retraction-fins;

a corresponding mating-connector having a plurality of mating-electrical-terminals, said mating-connector releasably connected to the connector along a mating-axis such that the plurality of electrical-terminals mate with the plurality of mating-electrical-terminals when the connector is moved from an unmated-position to a mated-position, said mating-connector including a connector-shroud having side walls defining a shroud-cavity configured to receive the connector therein and a base; and a terminal-stabilizer slideably disposed within the shroud-cavity including a plurality of retraction-locks that engage the plurality of retraction-fins on the connector and defining a plurality of terminal-apertures that slideably engage the plurality of mating-electrical-terminals, said terminal-stabilizer moveable from a prestaged-position when the connector and the mating-connector are in the unmated-position to a seated-position when the connector is moved to the mated-position, thereby retracting the terminal-stabilizer from the seated-position to the prestaged-position when the connector is moved from the mated-position to the unmated-position, wherein the plurality of retraction-locks define a retraction-slot that slideably retain the plurality of retraction-fins, whereby the plurality of retraction-locks return to a neutral flex-position having no deflection perpendicular to the mating-axis when the plurality of retraction-locks retain the plurality of retraction-fins, wherein the connector also includes a plurality of release-ramps, and wherein the base also includes a plurality of beam-locks configured to retain the terminal-stabilizer in the prestaged-position and prevent a movement of the terminal-stabilizer until the plurality of release-ramps displace the plurality of beam-locks in an outward direction perpendicular to the mating-axis and enable the terminal-stabilizer to move to the seated-position when the connector is moved from the unmated-position to the mated-position.

2. The electrical connector assembly in accordance with claim 1, wherein the connector-shroud includes a plurality of index-beams, and wherein the terminal-stabilizer includes a plurality of index-slots that slideably engage the plurality of index-beams.

3. The electrical connector assembly in accordance with claim 1, wherein the plurality of beam-locks return to a relaxed-position having no deflection perpendicular to the mating-axis after the terminal-stabilizer is moved to the seated-position.

4. The electrical connector assembly in accordance with claim 1, wherein the terminal-stabilizer further includes a resilient member projecting from a bottom-surface of the terminal-stabilizer configured to urge the terminal-stabilizer from the seated-position to the prestaged-position.

5. The electrical connector assembly in accordance with claim 4, wherein the resilient member is characterized as having an arcuate shape.

6. The electrical connector assembly in accordance with claim 4, wherein the terminal-stabilizer further includes a plurality of resilient members projecting from the bottom-surface of the terminal-stabilizer configured to urge the terminal-stabilizer from the seated-position to the prestaged-position.

7. The electrical connector assembly in accordance with claim 6, wherein each resilient member in the plurality of the resilient members is characterized as having an arcuate shape.

* * * * *